US006488559B1

(12) United States Patent
Hintz

(10) Patent No.: US 6,488,559 B1
(45) Date of Patent: Dec. 3, 2002

(54) BUG-LIKE FLIPPING TOY

(76) Inventor: Pearl Hintz, 3168 Bow St. Northeast, Moses Lake, WA (US) 98837

( * ) Notice: Subject to any disclaimer, the term of this patent is extended or adjusted under 35 U.S.C. 154(b) by 0 days.

(21) Appl. No.: 10/109,922

(22) Filed: Mar. 29, 2002

(51) Int. Cl.[7] ..... A63H 33/00
(52) U.S. Cl. ..... 446/311; 446/486
(58) Field of Search ..... 446/308, 309, 446/311, 312, 385, 390, 431, 486

(56) References Cited

U.S. PATENT DOCUMENTS 2,817,925 A * 12/1957 Kelley ..... 446/311
5,928,055 A * 7/1999 Gramsch ..... 446/297
6,086,446 A * 7/2000 Arriola ..... 446/308

* cited by examiner

*Primary Examiner*—Jacob K. Ackun
(74) *Attorney, Agent, or Firm*—Michael I. Kroll

(57) ABSTRACT

A bug-like flipping toy is provided having four resilient leg members extending from a substantially horizontal body member with a depression member in the form of an extended posterior portion. Each leg member is a relatively flat elongated plate having a greater width at the point of adjoinment with the body member and tapering to a narrower, radial, distal foot. The leg members are paired into anterior legs and posterior legs with the anterior legs being elongated plates on a horizontal plane and posterior legs being elongated plates on a diagonal plane. An external force placed on the depression member will push the body member downward and cause the anterior legs to extend forward and the posterior legs to abduct due to their angular construction. When the external force is removed the resiliency of the leg members will cause them to rebound into their static positions thereby launching the present invention into a tumbling trajectory. Decorative attachments are provided to suggest an insect or an animal.

7 Claims, 6 Drawing Sheets

BUG-LIKE FLIPPING TOY

BACKGROUND OF THE INVENTION

1. Field of the Invention

The present invention relates generally to jumping toys and, more specifically, to a bug-like flipping toy having four resilient leg members extending from a substantially horizontal body member with a depression member in the form of an extended posterior portion that, when an external force is applied thereupon, will deform the leg members and create reciprocal tension between the surface that the toy is on and the body member until the external force is removed allowing the front legs to recoil and propel the anterior body portion upward as the two posterior legs rebound to their original position thereby launching the present invention tumbling into a horizontal and vertical trajectory.

2. Description of the Prior Art

There are other jumping toys designed for children's amusement. Typical of these is U.S Pat. No. 5,334,079 issued to John J. Gentile et al. on Aug. 2, 1994.

Another patent was issued to Christopher Shaw et al. on Feb. 7, 1989 as U.S. Pat. No. 4,802,880. Yet another U.S. Pat. No. 3,612,528 was issued to Marvin I. Glass et al. on Oct. 12, 1971 and still yet another was issued on Apr. 23, 1968 to Jack Zimmerman as U.S. Pat. No. 3,378,947. Another patent was issued to Howard E. Kelly on Dec. 31, 1957 as U.S. Pat. No. 2,817,925.

U.S. Pat. No. 5,334,079

Inventor: John J. Gentile et al.

Issued: Aug. 2, 1994

A toy for launching projectiles. The toy includes a flexible shell generally having a convex outer surface and a concave inner surface. The convex outer surface has a first protrusion and a plurality of claws. The concave inner surface has a second protrusion. A first projectile is mountable on the first protrusion. A second projectile is mountable on the second protrusion. When the first projectile is mounted on the first protrusion and the shell is inverted such that the convex outer surface becomes a concave surface, the plurality of claws grip the first projectile. Thereafter, when pressure is applied to the shell, the shell returns to its original non-inverted shape and the first projectile is discharged into the air. Moreover, when the second projectile is mounted on the second protrusion and the shell is inverted such that the convex outer surface becomes a concave surface and is thereafter dropped on a hard surface, the shell returns to its original non-inverted shape and the second projectile is discharged into the air.

U.S. Pat. No. 4,8002,880

Inventor: Christopher Shaw

Issued: Feb. 7, 1989

A jumping toy having thin flexible convex surface with at least two curved perimetral edge formation where the convex surface is adapted to bear against a second surface, and is manipulatively elastically deformable against a second surface so as to leap therefrom when the convex surface returns to its original shape. Such jumping toy having a representation of a frog in one embodiment and used in a football game in another embodiment.

U.S. Pat. No. 3,612,528

Inventor: Marvin I. Glass et al.

Issued: Oct. 12 1971

Game apparatus for playing a target game including a target member having a variably sized target opening and projectiles of unitary construction having deformable leg members which quickly resume their original positions upon release of an applied force to flip the projectile vertically and cause it to move in a horizontal direction.

U.S. Pat. No. 3,378,947

Inventor: Jack Zimmerman

Issued: Apr. 23, 1968

An animated toy comprising a substantially flat sheet with an apertured portion therein a resilient flap which can be bent and inserted into the apertured portion, whereby due to it's resiliency the flap will yieldably slide out of the apertured portion and spring into it's normally unstrained position.

U.S. Pat. No. 2,817,925

Inventor: Howard E. Kelley.

Issued: Oct. Dec. 31, 1957

A catapulting figure top comprising a base, means on said base for supporting said base in a stable attitude on a generally horizontal surface, a member movably attached at said base for generally up and down movement with respect to said base, said member being biased upwardly with respect to said base, at least, a portion of said member being accessible, when said base is resting on said surface, for manual depression of said member with respect to said base against said bias. And means for said member for engaging a portion of said base to transport upward impact of said member to said base when said member portion is released from depressed position, the energy of said upward impact being sufficient to bodily catapult the toy upward.

SUMMARY OF THE PRESENT INVENTION

The present invention relates generally to jumping toys and, more specifically, to a bug-like flipping toy having four resilient leg members extending from a substantially horizontal body member with a depression member in the form of an extended posterior portion. Each leg member is a relatively flat elongated plate having a greater width at the point of adjoinment with the body member and tapering to a narrower, radial, distal foot. The leg members are paired into anterior legs and posterior legs with the anterior legs being elongated plates on a horizontal plane and posterior legs being elongated plates on a diagonal plane. An external force placed on the depression member will push the body member downward and cause the anterior legs to extend forward and the posterior legs to abduct due to their angular construction. When the external force is removed the resiliency of the leg members will cause them to rebound into their static positions thereby launching the present invention into a tumbling trajectory.

A primary object of the present invention is to provide a bug-like toy having resilient leg members emanating from a substantially horizontal body member. When sufficient pressure is exerted upon the depression member to extend the leg members and then removed, the leg members will snap back to their static positions thereby flipping the bug into a tumbling trajectory.

Another object of the present invention is to provide a flipping bug-like toy having anterior legs with a generally horizontal width that extend arcuately forward and downward from the body member so the legs will flatten and extend when compressed. The posterior legs have a substantially vertical thickness with the bottom edge sloping away from the center enabling them to abduct when compressed. The difference between the anterior and posterior legs creates two distinct means of delivering the potential energy within the deformed leg members.

Another object of the present invention is to provide a flipping bug-like toy having a body with a depression member for the user to exert pressure upon, thereby deforming the legs and creating the potential power for the projection that will occur once the external pressure is removed.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is perspective view of the present invention on a flat surface ready for use.

FIG. 2 is a perspective view of the present invention in use. Shown is an external force being applied to the depression member causing the posterior leg members to separate to create the potential energy for propulsion which occurs once the external force is removed. Consequently, the anterior leg members release their tension and increase the tumbling motion of the present invention during its trajectory as shown in hidden line.

DESCRIPTION OF THE REFERENCED NUMERALS

Figure 1:
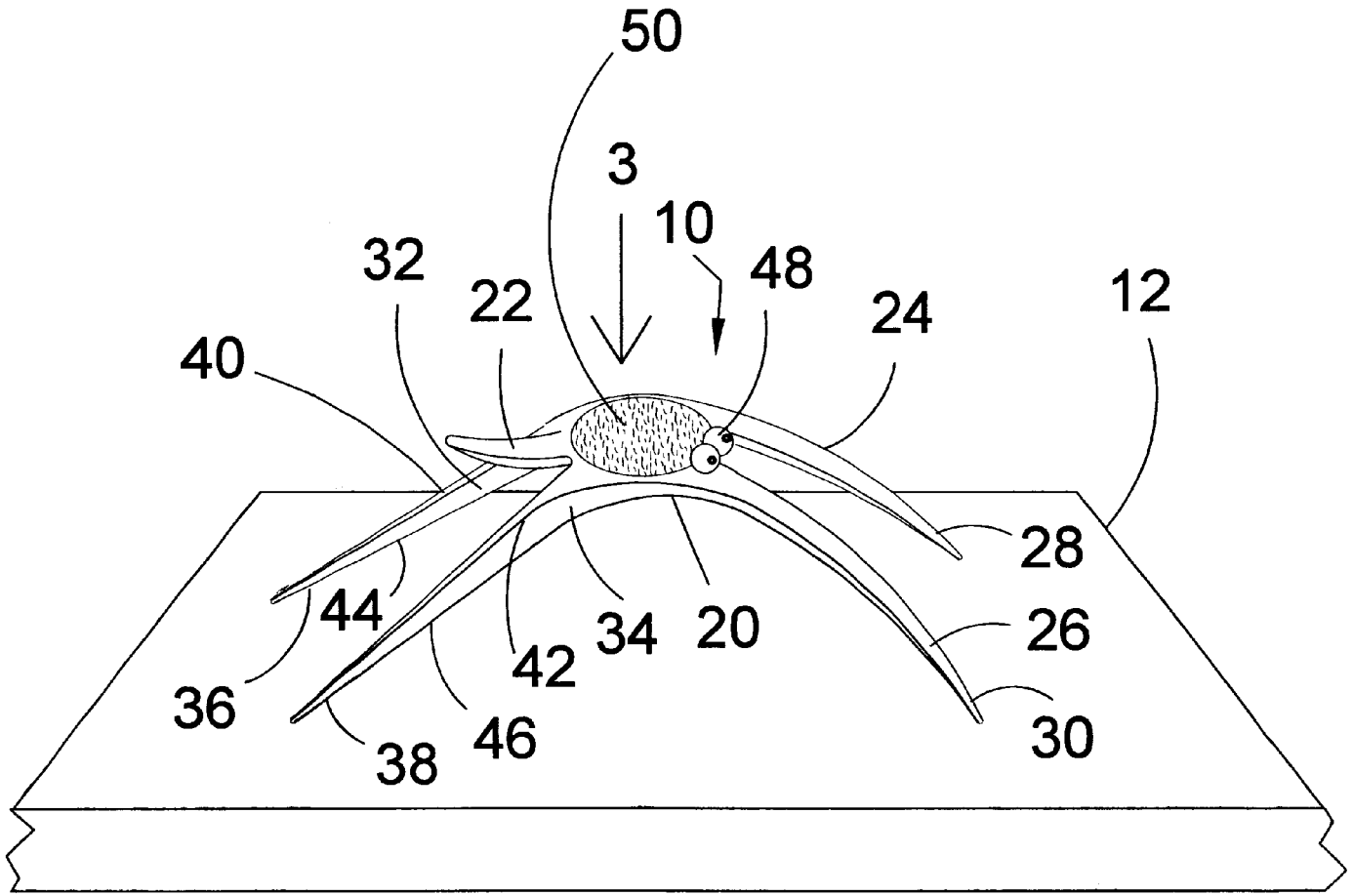

Turning now descriptively to the drawings, in which similar reference characters denote similar elements throughout the several views, the Figures illustrate the Bug-Like Flipping Toy of the present invention. With regard to the reference numerals used, the following numbering is used throughout the various drawing figures.

10 Bug-Like Flipping Toy of the present invention
12 horizontal surface
20 body
22 depression member
24 left anterior leg
26 right anterior leg
28 left anterior leg end
30 right anterior leg end
32 left posterior leg
34 right posterior leg
36 left posterior leg end
38 right posterior leg end
40 left posterior leg top edge
42 right posterior leg top edge
44 left posterior leg bottom edge
46 right posterior leg bottom edge
48 eyes
50 hair

DETAILED DESCRIPTION OF THE PREFERRED EMBODIMENT

Turning now descriptively to the drawings, in which similar reference characters denote similar elements throughout the several views, FIGS. 1–6 illustrate the Bug-Like Flipping Toy of the present invention indicated generally by the numeral 10.

Figure 2:
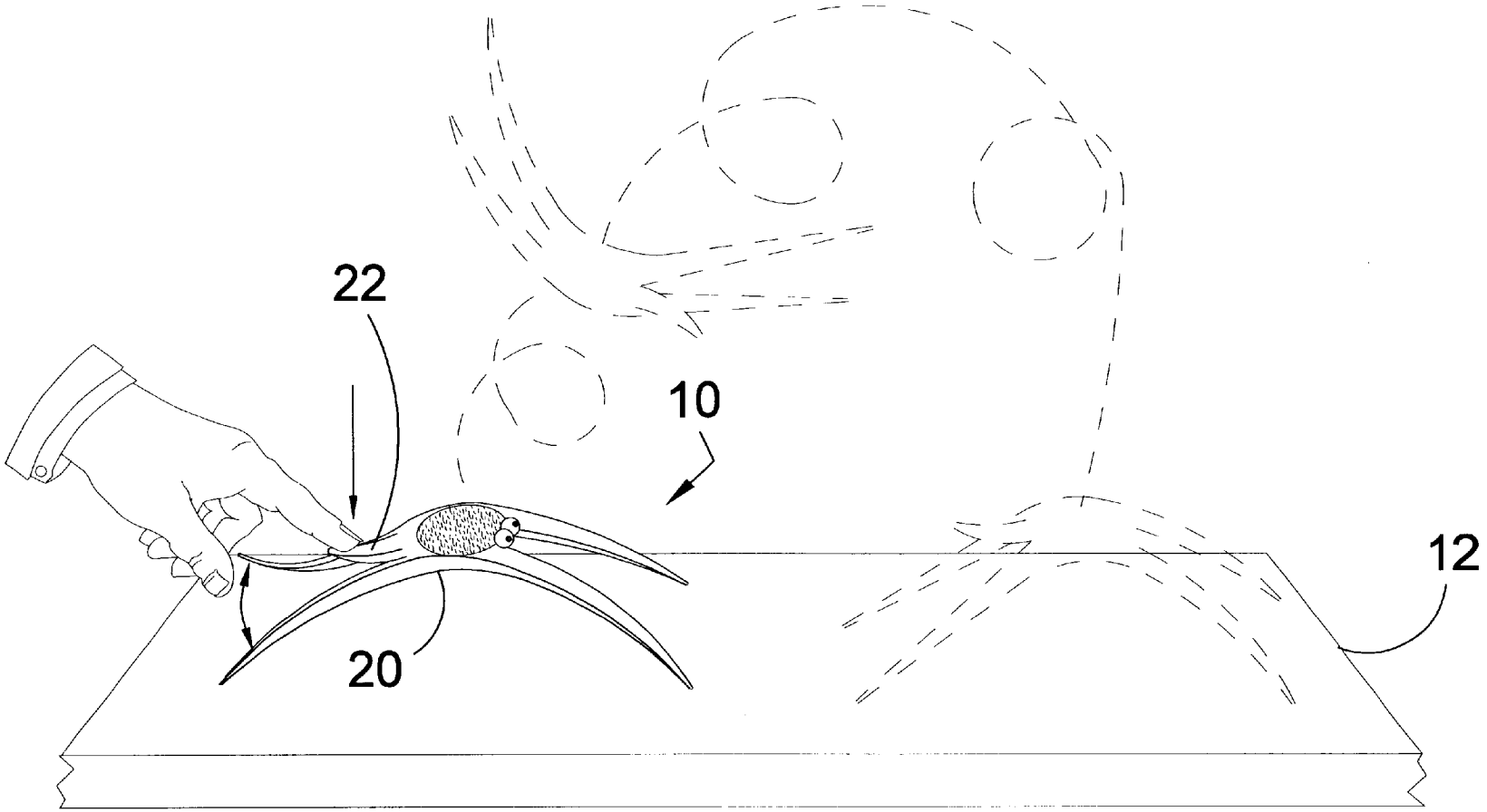

The device 10 is shown in FIG. 1. The device 10 will typically be used on a horizontal surface 12 as shown in FIGS. 1–2.

The device 10 has a body 20 and a depression member 22 extending rearwardly from the body 20, Also extending arcuately from the body 20 are left and right anterior legs 24,26, that are generally elongated planar surfaces that taper in width from the body 20 to the anterior leg ends 28,30. The anterior leg 24,26 width remains generally parallel to the horizontal surface 12 as the anterior legs approach such surface 12, such that when the device 10 is flattened against the surface 12, the anterior legs 24,26 will be generally flat to such surface 12.

Extending rearwardly from the body 20 are left and right posterior legs 32,34, that taper in width from the body 20 to left and right posterior leg ends 36,38. The posterior legs 32,34 are also generally elongated planar surfaces. Unlike the anterior legs 24,26, however, the planes in which the width of the posterior legs 32,34 lie are diagonally angled to the horizontal surface 12, as particularly depicted in FIG. 3 and FIG. 6. The top edges 40,42 of the posterior legs 32,34 are more disposed to the centerline of the body 20 than the bottom edges 44,46.

The body 20, depression member 22, anterior legs 24,26 and posterior legs 32,34 are constructed from resilient materials, such as plastic.

In a typical use of the device 10, the body 20 is supported above the horizontal surface 12 by the anterior legs 24,26 and posterior legs 32,34. The user pushes down on the depression member 22 causing resilient deformation of the anterior legs 24,26 and posterior legs 32,34. The anterior legs 24,26 deform such that the arcuate shape is generally flattened, while the posterior legs 32,34 abduct, with both posterior legs 32,34 spreading further from the centerline of the body 20.

These different deformation patterns create correspondingly different rebound patterns when the device 10 is released by removing pressure from the depression member 22. This difference causes the device 10 to be launched from the horizontal surface 22 in both an upward motion and a tumbling motion, one possible trajectory being shown in FIG. 2.

Upon full rebound the anterior legs 24,26 and posterior legs 32,34 are again in pre-deformation shape and the device 10 is ready for positioning on a horizontal surface 12 for the next use.

Figure 3:
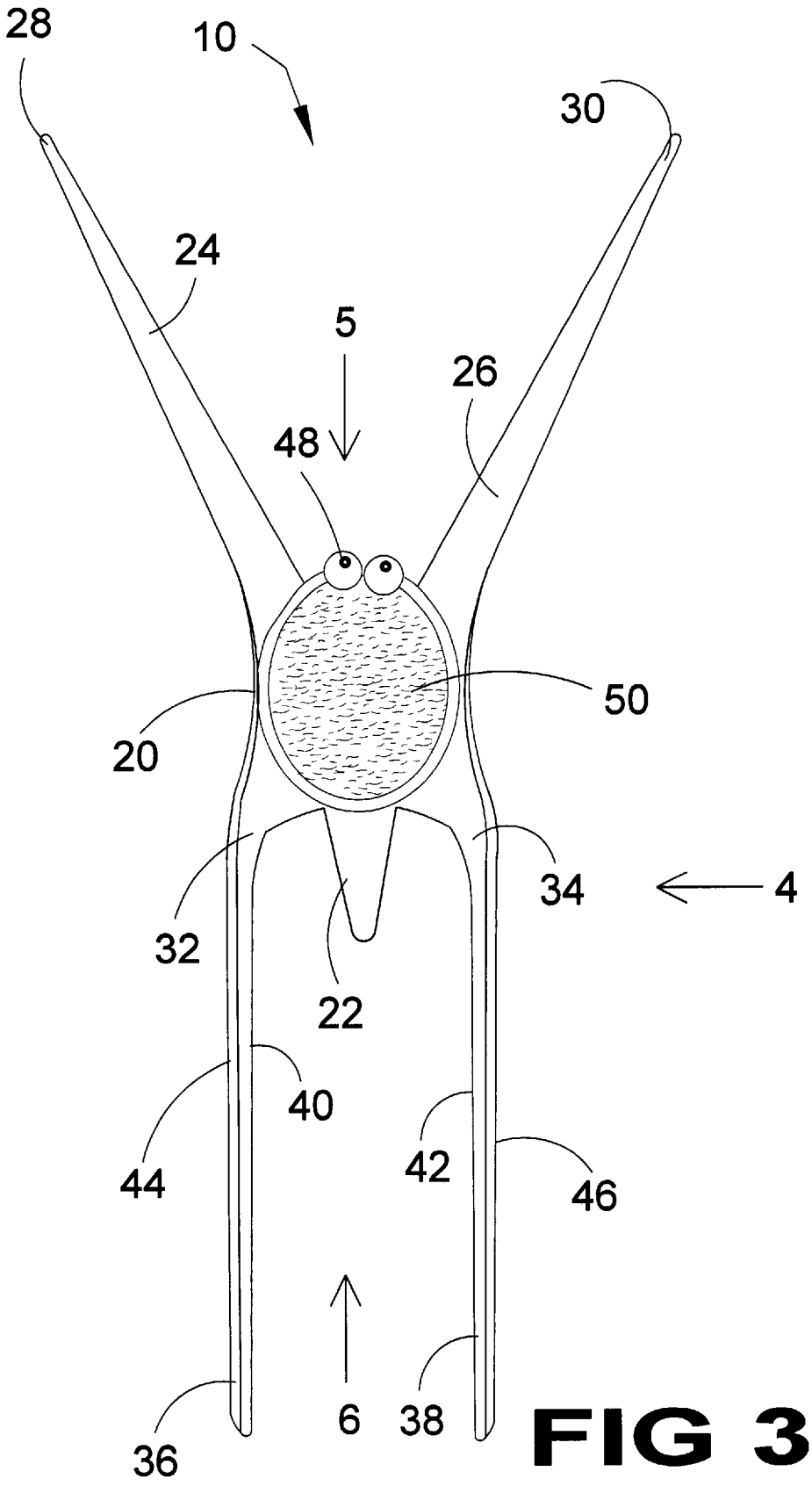
FIG. 3 is a top view of the present invention.
Figure 4:
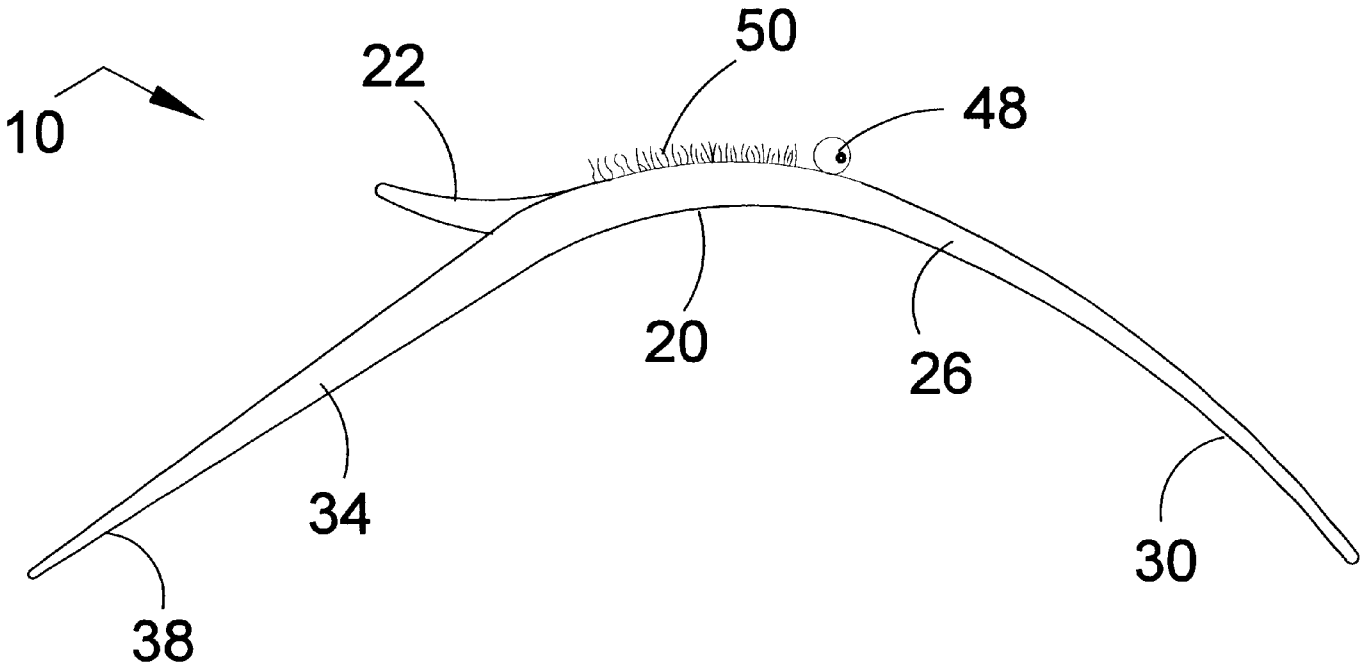
FIG. 4 is a side view of the present invention taken from FIG. 3 as indicated.
Figure 5:
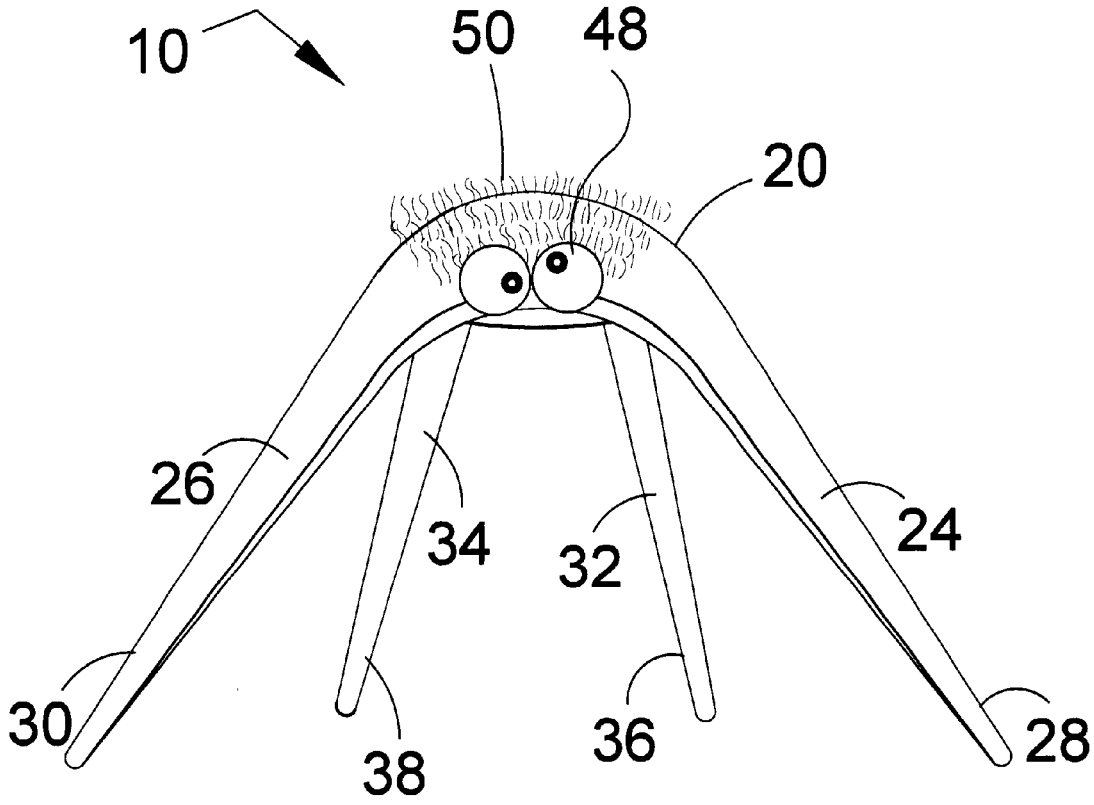
FIG. 5 is a front view of the present invention taken from FIG. 3 as indicated.
Figure 6:
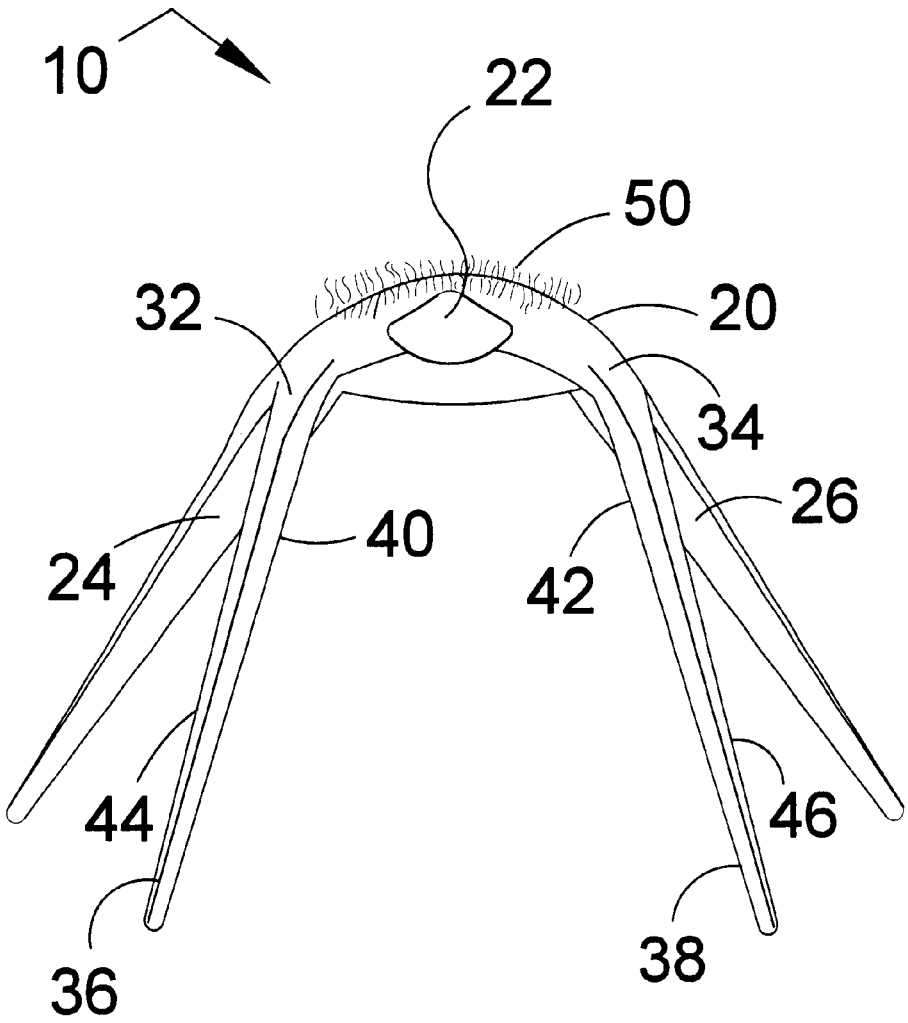
FIG. 6 is a rear view of the present invention taken from FIG. 3 as indicated.

The device 10 also includes decorative attachments to suggest an animal or insect, such as the imitation eyes 48 and hair 50, as shown from the top, front and side in FIGS. 3–5.

Although plastic has been indicated for the material, and eyes and hair have been indicated for the animation, other materials and decorative attachments can also be used, such as rubber or various metals for the construction material, and ears, horns, teeth, etc. for the animation, all in accordance with the present invention, and as determined by the intended end use for the overall device, as will occur to those of skill in the art upon review of the present disclosure.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy, of the type that is typically used on a horizontal surface, comprising:

(a) a body;

(b) a pair of anterior legs, the anterior legs extending forwardly and arcuately from the body, the anterior legs being resilient, each anterior leg having an end, each anterior leg further having a width that tapers as the anterior leg extends from the body to the anterior leg end, each anterior leg's width being generally parallel to the horizontal surface;

(c) a pair of posterior legs, the posterior legs extending rearwardly from the body, the posterior legs being resilient, each posterior leg having an end, each posterior leg further having a width that tapers as the posterior leg extends from the body to the posterior leg end, each posterior leg further having a top edge and a bottom edge, each posterior leg's top edge being sloped toward the other posterior leg's top edge, such that the posterior legs' top edges are closer together than the bottom edges, the anterior legs and posterior legs being further positioned such that the body is elevated above the horizontal surface; and (d) a depression member extending rearwardly from the body, such that when the depression member is pushed in a downward direction the anterior legs and posterior legs deform resiliently, such that when the depression member is released, the anterior legs and posterior legs rebound to the pre-deformation shape, the rebound being at a velocity such that the toy is launched from the horizontal surface, the configuration of the anterior legs and posterior legs being sufficiently different to cause the toy to move off the horizontal surface in both an upward motion and in a tumbling motion.

2. The device of claim 1, wherein the posterior leg ends are closer together than the anterior leg ends prior to the resilient deformation.

3. The device of claim 1, wherein artificial hair is attached to the body.

4. The device of claim 1, wherein imitation eyes are attached to the body.

5. The device of claim 1, wherein decorative materials are attached to the body.

6. The device of claim 5, wherein the decorative materials suggest an insect or an animal.

7. A toy, of the type that is typically used on a horizontal surface, comprising:

(a) a body;

(b) a depression member attached to the body;

(c) first means for urging the toy from the horizontal surface; and (d) second means for urging the toy from the horizontal surface, the timing of the first and second means being such that the toy moves in both an upward motion and in a tumbling motion.

* * * * *